US008690528B2

(12) United States Patent
Kato et al.

(10) Patent No.: US 8,690,528 B2
(45) Date of Patent: Apr. 8, 2014

(54) COUNTER-ROTATING AXIAL FLOW FAN

(75) Inventors: Chisachi Kato, Tokyo (JP); Atsushi Yamaguchi, Kanagawa (JP); Akira Ueda, Kanagawa (JP); Kazuhiro Nitta, Kanagawa (JP); Akihiro Otsuka, Sr., Kanagawa (JP); Tadashi Katsui, Kanagawa (JP); Masahiro Suzuki, Kanagawa (JP); Yoshihiko Aizawa, Nagano (JP); Honami Oosawa, Nagano (JP)

(73) Assignees: The University of Tokyo, Tokyo (JP); Sanyo Denki Co., Ltd., Tokyo (JP); Fujitsu Limited, Kawasaki-Shi (JP)

( * ) Notice: Subject to any disclaimer, the term of this patent is extended or adjusted under 35 U.S.C. 154(b) by 662 days.

(21) Appl. No.: 12/967,200

(22) Filed: Dec. 14, 2010

(65) Prior Publication Data

US 2011/0142612 A1 Jun. 16, 2011

(30) Foreign Application Priority Data

Dec. 14, 2009 (JP) ..... 2009-283287

(51) Int. Cl.
*F04D 29/44* (2006.01)

(52) U.S. Cl.
USPC ..... 415/199.5; 415/211.2; 416/128

(58) Field of Classification Search
USPC ..... 415/199.5, 211.2; 416/124, 125, 128, 416/129, 198 R, 199, 243, 198 A
See application file for complete search history.

(56) References Cited

U.S. PATENT DOCUMENTS

| | | | | |
|---|---|---|---|---|
| 7,445,423 | B2 | 11/2008 | Ishihara | |
| 2002/0006331 | A1* | 1/2002 | Moreau et al. | 415/211.2 |
| 2007/0122271 | A1* | 5/2007 | Ishihara et al. | 415/191 |

FOREIGN PATENT DOCUMENTS

| | | |
|---|---|---|
| JP | 4128194 | 7/2008 |

* cited by examiner

*Primary Examiner* — Edward Look
*Assistant Examiner* — Maxime Adjagbe
(74) *Attorney, Agent, or Firm* — Rankin, Hill & Clark LLP

(57) ABSTRACT

A counter-rotating axial flow fan in which the shape of stationary blades of a middle stationary portion is optimized to reduce noise is provided. Defining the maximum axial chord length of front blades as Lf, the maximum axial chord length of rear blades as Lr, and the maximum axial chord length of stationary blades as Lm, a relationship of Lm/(Lf+Lr)<0.14 is satisfied. Defining the maximum dimension between the blade chord for lower surfaces of the stationary blades and the lower surfaces as K1, the maximum axial chord length Lm of the stationary blades satisfies a relationship of Lm/K1>5.8.

4 Claims, 8 Drawing Sheets

COUNTER-ROTATING AXIAL FLOW FAN

TECHNICAL FIELD

The present invention relates to a counter-rotating axial flow fan with a front impeller and a rear impeller configured to rotate in opposite directions to each other.

BACKGROUND ART

A conventional counter-rotating axial flow fan is disclosed in Japanese Patent No. 4128194. The counter-rotating axial flow fan includes a casing including an air channel having a suction port on one side in an axial direction and a discharge port on the other side in the axial direction, a front impeller including a plurality of front blades and configured to rotate in the air channel, a rear impeller including a plurality of rear blades and configured to rotate in the air channel, and a middle stationary portion formed by a plurality of stationary blades or struts disposed to be stationary between the front impeller and the rear impeller in the air channel.

In the counter-rotating axial flow fan, the front impeller, the rear impeller, and the middle stationary portion are elaborately shaped to reduce noise. However, thorough studies on the relationship between the middle stationary portion and noise have not been made so far.

SUMMARY OF THE INVENTION

An object of the present invention is to provide a counter-rotating axial flow fan in which the shape of stationary blades of a middle stationary portion is optimized to reduce noise.

A counter-rotating axial flow fan improved by the present invention includes: a casing including an air channel having a suction port on one side in an axial direction and a discharge port on the other side in the axial direction; a front impeller including a plurality of front blades and configured to rotate in the air channel; a rear impeller including a plurality of rear blades and configured to rotate in the air channel in a direction opposite to a direction of rotation of the front impeller; and a middle stationary portion disposed between the front impeller and the rear impeller in the air channel. The middle stationary portion includes a hub which is disposed to be stationary between the front impeller and the rear impeller in the air channel and to which a motor section configured to drive the front impeller and the rear impeller is fixed, and a plurality of stationary blades coupled to an outer peripheral surface of the hub and an inner peripheral surface of the casing and disposed at intervals in a circumferential direction of the air channel.

In the counter-rotating axial flow fan according to the present invention, defining the maximum axial chord length of the front blades (the maximum length of the front blades as measured along the axial direction) as Lf, the maximum axial chord length of the rear blades (the maximum length of the rear blades as measured along the axial direction) as Lr, and the maximum axial chord length of the stationary blades (the maximum length of the stationary blades as measured along the axial direction) as Lm, Lf, Lr, and Lm each being a positive integer, a relationship of $Lm/(Lf+Lr)<0.14$ is satisfied. In the present invention, defining the rotational direction of the front impeller as a forward rotational direction, surfaces of the stationary blades facing the forward rotational direction as upper surfaces, and surfaces of the stationary blades facing a direction opposite to the forward rotational direction as lower surfaces, the upper surfaces and the lower surfaces of the stationary blades are curved to be convex toward the forward rotational direction. Moreover, the stationary blades are formed such that the axial chord length thereof becomes larger from an inner end located on the hub side toward an outer end located on the casing side. Further, defining the maximum dimension between the blade chord for the lower surfaces and the lower surfaces as K1, the stationary blades are formed such that the maximum dimension K1 becomes larger from the inner end toward the outer end and a relationship of $Lm/K1>5.8$ is satisfied.

The above relationships have been found by the inventors as a result of study on a relationship that reduces noise produced by a counter-rotating axial flow fan. The conventional or existing counter-rotating axial flow fans do not satisfy the above relationships. It has been verified that a counter-rotating axial flow fan that satisfies the above relationships may reduce noise compared to the existing counter-rotating axial flow fans. The present invention has been made on the basis of such verifications. If the above relationships are satisfied, it may be possible to effectively prevent or restrain flow separation of a fluid from the stationary blades, thereby reducing noise, the fluid being discharged from the front blades and flowing along the surfaces of the stationary blades.

While the above effect can be obtained by satisfying the above relationships, it is preferable that the stationary blades are shaped such that the maximum dimension K1 becomes closer to zero toward the hub, in addition to the above relationships. With this configuration, noise can be further reduced.

Preferably, the plurality of stationary blades are disposed at equidistant intervals in the circumferential direction. If this requirement is met, noise can be reduced compared to when the requirement is not met.

If lead wires are exposed in a space in which a fluid flows, the presence of the lead wires increases noise. Thus, preferably, a plurality of lead wires extending from the motor section pass inside at least one of the stationary blades to be pulled out of the casing. Alternatively, a plurality of lead wires extending from the motor section may be pulled out of the casing with the lead wires being in close contact with a side or lower surface of at least one of the stationary blades. With this configuration, the work of installing the lead wires is facilitated.

DESCRIPTION OF THE PREFERRED EMBODIMENTS

Figure 1:
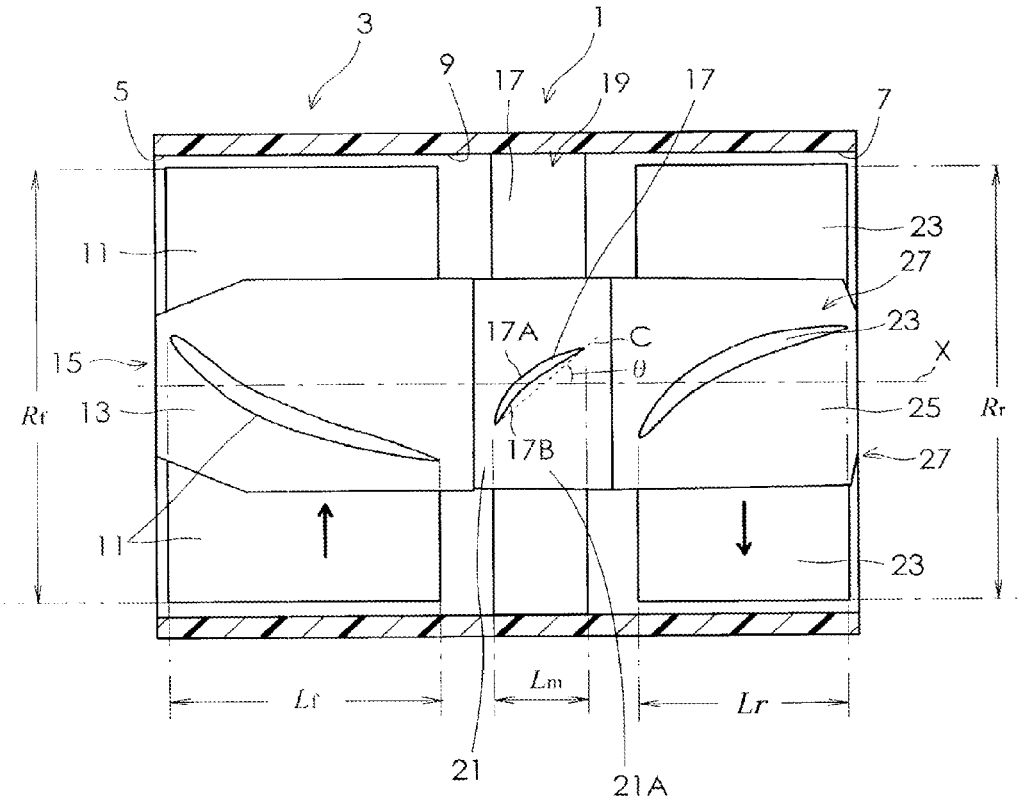
FIG. 1 schematically shows the configuration of a counter-rotating axial flow fan according to an embodiment of the present invention.

A counter-rotating axial flow fan according to an embodiment of the present invention will be described below with reference to the drawings. FIG. 1 schematically shows the configuration of a counter-rotating axial flow fan 1 according to the embodiment, in which only a cylindrical casing 3 is shown in cross section. The casing 3 includes an air channel 9 having a suction port 5 on one side in an axial direction of an axial line X and a discharge port 7 on the other side in the axial direction. The casing 3 may be formed by assembling two divided casings which make a dividing plane at a center in the axial direction of the casing 3 wherein the two divided casings are assembled. The dividing plane extends in the direction orthogonal to the axial line X. A front impeller 15 comprises a hub 13 and a plurality of front blades 11 fixed to the hub 13, and is disposed inside the air channel 9 at the side of the suction port 5. The plurality of front blades 11 are disposed at equidistant intervals in the circumferential direction of the hub 13. An end of each of the front blades 11 is fixed to an outer peripheral portion of the hub 13. A rotor of a front motor serving as a drive source for the front impeller 15 is fixed inside the hub 13. A middle stationary portion 19 includes a plurality of stationary blades 17, and is disposed in a center portion of the air channel 9. One end of each of the plurality of stationary blades 17 is fixed to an outer peripheral portion of a hub 21, and the other end of each of the stationary blades 17 is fixed to an inner wall portion of the casing 3. The hub 21 is structured to include a partition wall portion (not shown) provided in a center portion of a cylindrical portion 21A. A stator of the front motor mentioned above is fixed to the partition wall portion (not shown) of the hub 21. The plurality of stationary blades 17 are disposed on an outer peripheral portion of the cylindrical portion 21A of the hub 21 at equidistant intervals in the circumferential direction. A rear impeller 27 comprises a plurality of rear blades 23 and a hub 25, and is disposed inside the air channel 9 at the side of the discharge port 7. The plurality of rear blades 23 are disposed at equidistant intervals in the circumferential direction of the hub 25. An end of each of the rear blades 23 is fixed to an outer peripheral portion of the hub 25. A rotor of a rear motor serving as a drive source for the rear impeller 27 is fixed inside the hub 25. A stator of the rear motor is fixed to the partition wall portion (not shown) of the hub 21 of the middle stationary portion 19.

In the counter-rotating axial flow fan 1 according to the embodiment, defining the number of the front blades 11 as N, the number of the stationary blades 17 as M, and the number of the rear blades 23 as P, N, M, and P each being a positive integer, and defining the maximum axial chord length of the front blades 11 (the maximum length of the front blades 11 as measured along the axial direction of the axial line X) as Lf, the maximum axial chord length of the rear blades 23 (the maximum length of the rear blades 23 as measured along the axial direction of the axial line X) as Lr, the maximum axial chord length of the stationary blades 17 (the maximum length of the stationary blades 17 as measured along the axial direction of the axial line X) as Lm, the outside diameter of the front blades 11 (the maximum diameter of the front impeller 15 including the front blades 11 as measured in the radial direction orthogonal to the axial direction) as Rf, and the outside diameter of the rear blades 23 (the maximum diameter of the rear impeller 27 including the rear blades 23 as measured in the radial direction orthogonal to the axial direction) as Rr, Lf, Lr, Lm, Rf, and Rr each being a positive integer, a relationship of $Lm/(Lf+Lr)<0.14$ is satisfied. While the number N of the front blades 11, the number M of the stationary blades 17, and the number P of the rear blades 23 preferably satisfy a relationship of $N \geq P > M$, this relationship is not essential to the present invention.

The embodiment adopts a design concept for reducing loss caused by the stationary blades 17 as much as possible. In the embodiment, the relationship of $N \geq P > M$ is added to obtain the effect of reducing loss caused by the rear blades 23 and to enable the rear blades 23 to work to rectify a swirling flow (to cause the rear blades 23 to also work to do what the ordinary stationary blades do). In the design concept for reducing loss caused by the stationary blades 17 as much as possible, the relationship of $Lm/(Lf+Lr)<0.14$ defines the upper limit of the maximum axial chord length Lm of the stationary blades 17. There are no counter-rotating axial flow fans known in the art wherein the value of $Lm/(Lf+Lr)$ is less than 0.14. Thus, the defined upper Limit is provided to exclude the counter-rotating axial flow fans known in the art from the present invention, rather than to set a critical limit to the maximum axial chord length Lm of the stationary blades 17.

Figure 2:
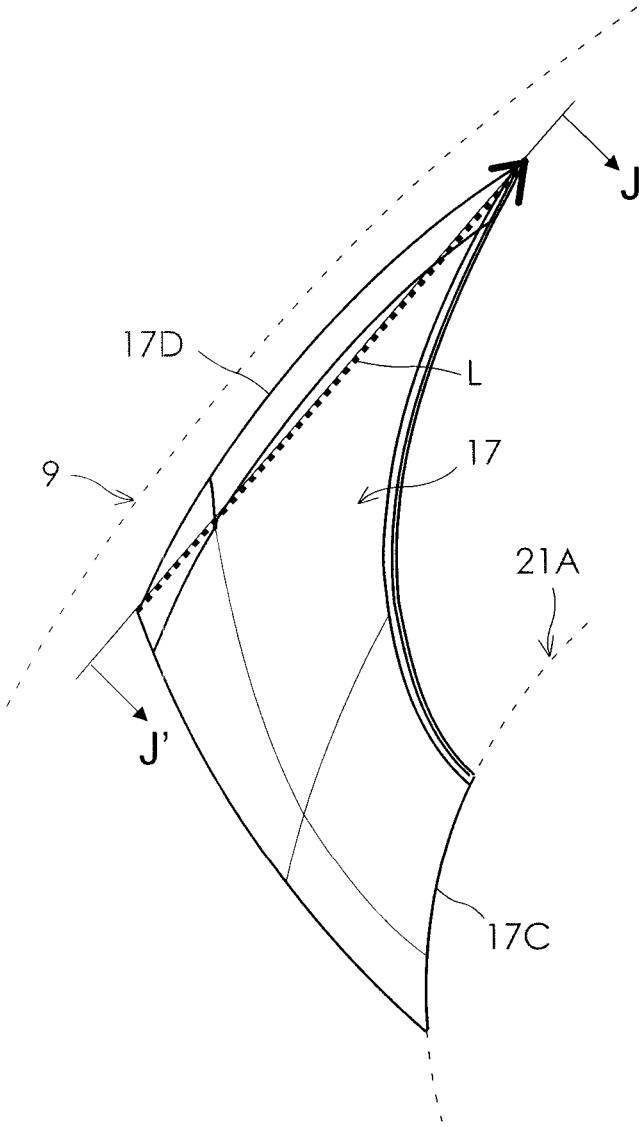
FIG. 2 is a plan view of an example of stationary blades used in the embodiment as viewed from the side of front blades.
Figure 3:
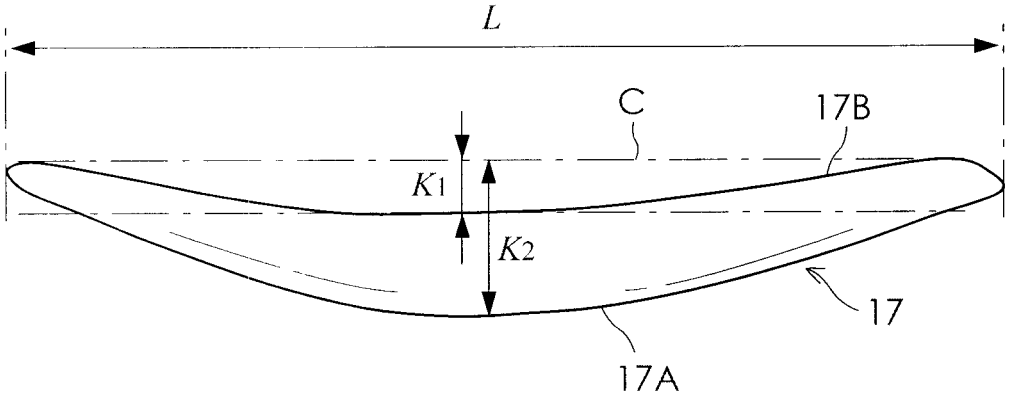
FIG. 3 shows the profile of a cross section taken along line J-J' of FIG. 2.
Figure 4:
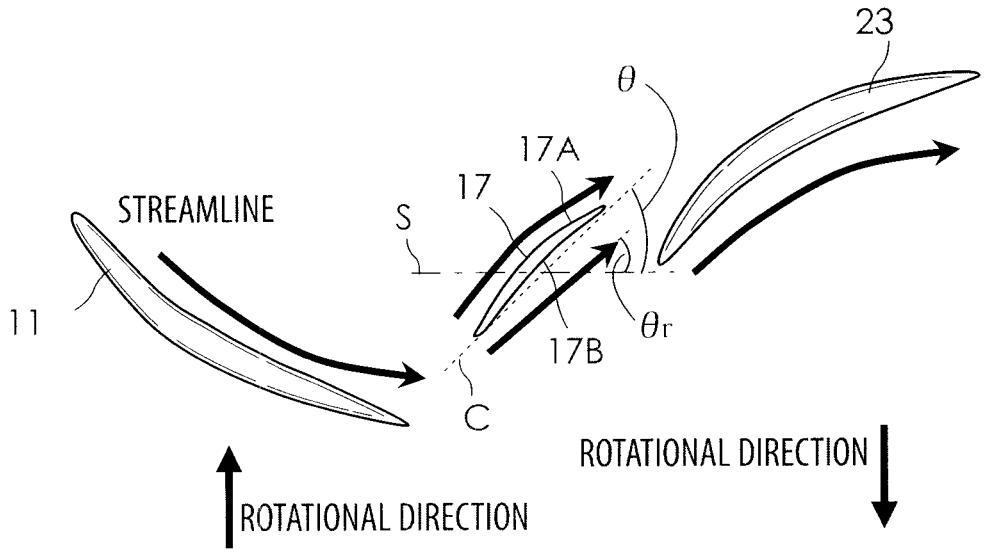
FIG. 4 illustrates the structure and the effect of stationary blades with streamlines shown around the respective blades.

FIG. 2 is a plan view of an example of the stationary blades 17 used in the embodiment as viewed from the side of the front blades 13. FIG. 3 shows the profile of a cross section taken along line J-J' of FIG. 2. FIG. 4 illustrates the structure and the effect of the stationary blades 17 with streamlines shown around the respective blades. Defining the rotational direction of the front impeller 15 as a forward rotational direction, surfaces of the stationary blades 17 facing the forward rotational direction as upper surfaces 17A, and surfaces of the stationary blades 17 facing a direction opposite to the forward rotational direction as lower surfaces 17B, the upper surfaces 17A and the lower surfaces 17B of the stationary blades 17 are curved to be convex toward the forward rotational direction. The stationary blades 17 are formed such that the axial chord length L thereof becomes larger from an inner end 17C located on the hub 21 side toward an outer end 17D located on the casing 3 side. Further, defining the maximum dimension between the blade chord C for the lower surfaces 17B and the lower surfaces 17B as K1, the stationary blades 17 are formed such that the maximum dimension K1 becomes larger from the inner end 17C toward the outer end 17D. In the stationary blades 17 the maximum axial chord length Lm of the stationary blades 17 and the maximum dimension K1 satisfy a relationship of $Lm/K1>5.8$. The relationship of $Lm/K1>5.8$ has been found through testing. According to the test results, a counter-rotating axial flow fan in which the relationship of $Lm/(Lf+Lr)<0.14$ is satisfied and in which the stationary blades 17 are formed such that the maximum dimension K1 becomes larger from the inner end 17C toward the outer end 17D tended to produce larger noise as Lm/K1 becomes larger, and to produce smaller noise as Lm/K1 becomes smaller. The relationship of $Lm/K1>5.8$ is specified, on the basis of such tendencies, as a range in which noise is reduced compared to the existing counter-rotating axial flow fans. In view of the design concept of the stationary blades 17 according to the embodiment, the shape of the upper surface 17A would not be significantly different from the shape of the lower surface 17B. According to the study made by the inventors, the shape of the upper surfaces 17A are not so influential as the shape of the lower surfaces 17B. Thus, defining the maximum dimension between the upper surface 17A and the blade chord C for the upper surfaces 17A as K2, the relationship between the maximum axial chord length Lm of the stationary blade 17 and the maximum dimension K2, namely Lm/K2, is not so important, and may be consequently determined in accordance with the shape of the lower surface 17B.

It has been found that defining the angle between an imaginary plane S including the axial line X and passing through the center of the stationary blade 17 and the blade chord C of the stationary blade 17 (an imaginary line connecting the two intersection points of the upper surface 17A and the lower surface 17B) as a blade angle θ and defining the angle of a rotational component of a swirling flow or rotational fluid flow discharged from the front impeller 15 at the target operating point as θr as shown in FIG. 4, the blade angle θ is preferably a value close to θr. However, the allowable range of deviation is not specifically limited.

The arrows shown in FIG. 4 represent streamlines indicating the flow path of the fluid flow produced by the front blades 11, the stationary blades 17, and the rear blades 23. According to the embodiment in which the above relationships are satisfied, a loss produced by the presence of the stationary blades 17 can be minimized. If the above relationships are satisfied, in addition, it is possible to effectively prevent or restrain flow separation of a fluid flowing along the surfaces of the stationary blades 17 from the surfaces (in particular, the upper surfaces 17A) of the stationary blades 17, thereby reducing noise.

In the embodiment, in addition to the above relationships, the stationary blades 17 are shaped such that the maximum dimension K1 becomes closer to zero toward the hub 21. That is, the stationary blades 17 are shaped such that the lower surface 17B become flatter toward the hub 21. Such stationary blades 17 produce small noise compared to stationary blades shaped such that the lower surface 17B does not become flatter toward the hub 21.

Figure 5:
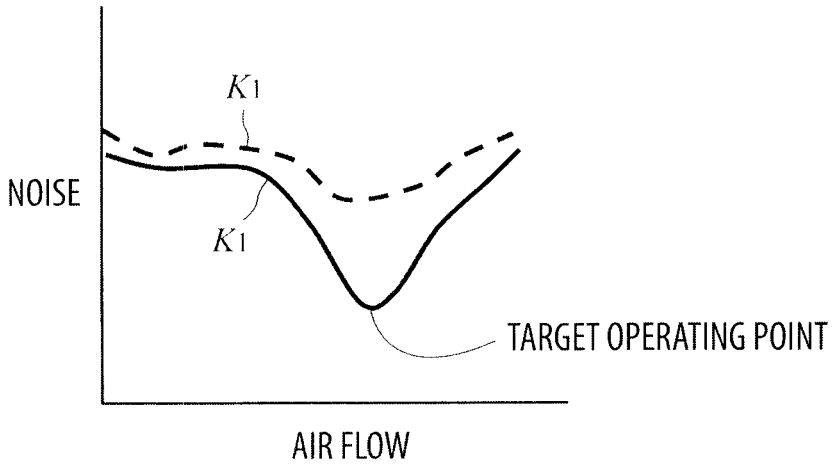
FIG. 5 shows the noise—air flow characteristics for small and large values of K1.
Figure 6A:
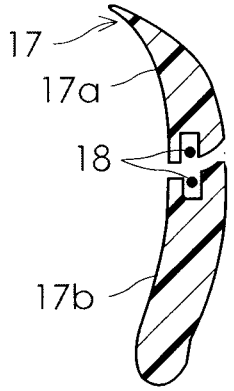
FIGS. 6A and 6B are each a cross-sectional view illustrating an exemplary structure in which thin lead wires are installed in a stationary blade.
Figure 6B:
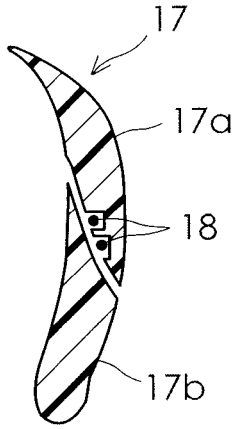

FIG. 5 shows the tendency of variations in noise level for different values of K1 at the target operating point with the blade angle θ of the stationary blades 17 constant, with the rotational speeds of the front impeller 15 and the rear impeller 27 each constant, with Lm and K2 each constant, and with motor's lead wires installed in the stationary blade 17 as shown in FIG. 6A or 6B and extending out of the casing 3. In FIG. 5, the dotted line indicates the noise—air flow characteristics with K1 at a large value, and the solid line indicates the noise—air flow characteristics with K1 at a small value. As seen from the noise—air flow characteristics shown in FIG. 5, noise produced by the entire fan can be reduced by optimizing the shape of the stationary blades 17. The data shown in FIG. 5 are obtained with K2 becoming smaller as K1 becomes smaller. In the examples of FIGS. 6A and 6B, thin lead wires with a low withstand voltage, such as thin enameled wires or polyurethane enameled wires, formed by coating the surface of a conductor with an electric insulating material are used as lead wires 18. The lead wires 18 are installed in a path constructed by recesses formed at the mating surfaces of two divided stationary blades 17*a* and 17*b*, as in the structure disclosed in Japanese Patent No. 4128194. The structure for installing the lead wires 18 in the stationary blade 17 is not limited to the examples of FIGS. 6A and 6B, and the stationary blade 17 may be molded with the lead wires 18 embedded as inserts. If a structure in which the lead wires 18 are not exposed as in the above embodiment is adopted, the effect obtained by the stationary blades 17 configured to satisfy the above relationships can be maximized. When thin lead wires are used, all the lead wires may be installed in at least one stationary blade, or the lead wires may be installed in respective stationary blades in a distributed manner. Such thin Lead wires may be connected to ordinary thick coated lead wires outside the casing 3 using connectors.

Figure 7A:
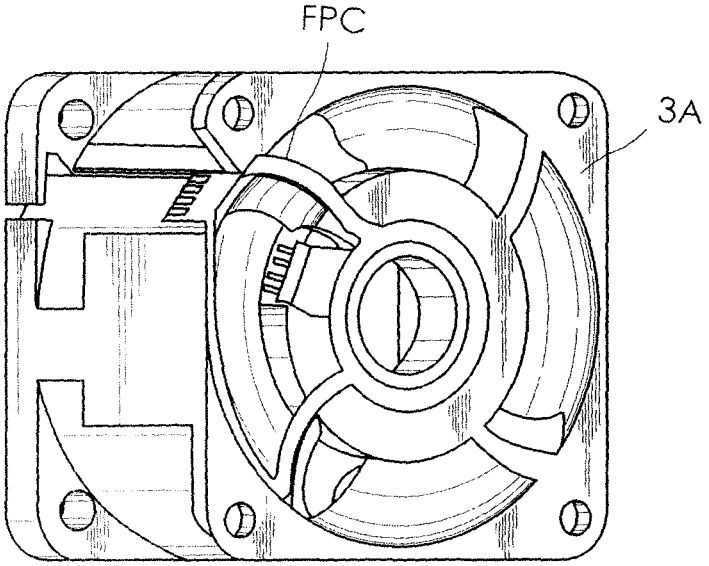
FIG. 7A illustrates a structure in which a flexible printed wiring board is used in place of the lead wires.
Figure 7B:
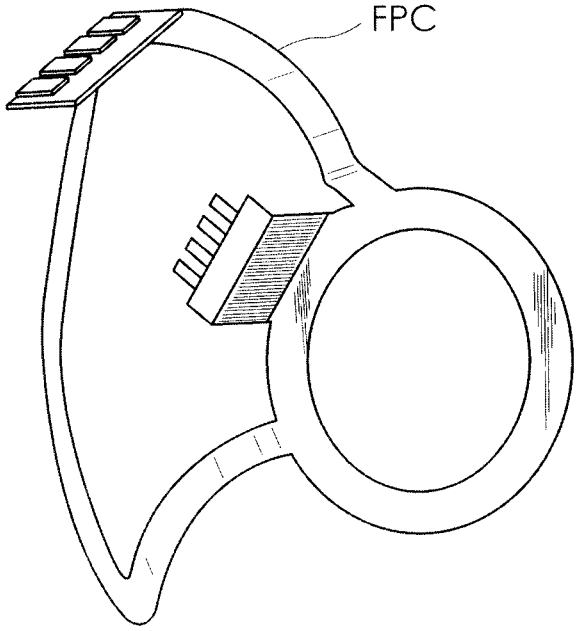
FIG. 7B shows the flexible printed wiring board.

Alternatively, a flexible printed wiring board or wire harness may be used without using thin lead wires. FIG. 7A shows a flexible printed wiring board FPC mounted on one of two divided casings 3A which construct the casing 3, as in the fan disclosed in Japanese Patent No. 4128194. FIG. 7B shows only the flexible printed wiring board FPC. In the example, the main portion of the flexible printed wiring board FPC is sandwiched between the divided casing 3A and the other divided casing (not shown). Thus, the presence of the flexible printed wiring board FPC does not cause noise.

Further, it is a matter of course that thin lead wires may be fixed to the lower surface 17B of the stationary blade 17 using an adhesive tape or a thinly applied adhesive film.

According to the counter-rotating axial flow fan of the present invention, loss produced by stationary blades is reduced, improved characteristics are provided, and noise is reduced compared to the existing counter-rotating axial flow fans, thereby providing industrial applicability.

While certain features of the invention have been described with reference to example embodiments, the description is not intended to be construed in a limiting sense. Various modifications of the example embodiments, as well as other embodiments of the invention, which are apparent to persons skilled in the art to which the invention pertains, are deemed to lie within the spirit and scope of the invention.

What is claimed is:

1. A counter-rotating axial flow fan comprising:

a casing including an air channel having a suction port on one side in an axial direction and a discharge port on the other side in the axial direction;

a front impeller including a plurality of front blades and configured to rotate in the air channel;

a rear impeller including a plurality of rear blades and configured to rotate in the air channel; and a middle stationary portion including a hub which is disposed to be stationary between the front impeller and the rear impeller in the air channel and to which a motor section configured to drive the front impeller and the rear impeller is fixed, and a plurality of stationary blades coupled to an outer peripheral surface of the hub and an inner peripheral surface of the casing and disposed at intervals in a circumferential direction of the air channel, wherein:

defining the maximum axial chord length of the front blades as Lf, the maximum axial chord length of the rear blades as Lr, and the maximum axial chord length of the stationary blades as Lm, Lf, Lr, and Lm each being a positive integer, the following relationship is satisfied: $Lm/(Lf+Lr)<0.14$;

defining the rotational direction of the front impeller as a forward rotational direction, surfaces of the stationary blades facing the forward rotational direction as upper surfaces, and surfaces of the stationary blades facing a direction opposite to the forward rotational direction as lower surfaces, the upper surfaces and the lower surfaces of the stationary blades are curved to be convex toward the forward rotational direction;

the stationary blades are formed such that the axial chord length thereof becomes larger from an inner end located on the hub side toward an outer end located on the casing side;

defining the maximum dimension between the blade chord for the lower surfaces and the lower surfaces as K1, the stationary blades are formed such that the maximum dimension K1 becomes larger from the inner end toward the outer end and a relationship of $Lm/K1>5.8$ is satisfied; and the stationary blades are shaped such that the maximum dimension K1 becomes closer to zero toward the hub.

2. The counter-rotating axial flow fan according to claim 1, wherein the plurality of stationary blades are disposed at equidistant intervals in the circumferential direction.

3. The counter-rotating axial flow fan according to claim 2, wherein a plurality of lead wires extending from the motor section pass inside at least one of the stationary blades to be pulled out of the casing.

4. The counter-rotating axial flow fan according to claim 2, wherein a plurality of lead wires extending from the motor section are pulled out of the casing with the lead wires being in close contact with the lower surface of at least one of the stationary blades.

* * * * *

UNITED STATES PATENT AND TRADEMARK OFFICE

CERTIFICATE OF CORRECTION

PATENT NO. : 8,690,528 B2
APPLICATION NO. : 12/967200
DATED : April 8, 2014
INVENTOR(S) : Chisachi Kato et al.

It is certified that error appears in the above-identified patent and that said Letters Patent is hereby corrected as shown below:

On the Title Page
Item (75) Inventors
Change "Akihiro Otsuka, Sr." to --Akihiro Otsuka--

Signed and Sealed this
Twenty-second Day of July, 2014

Michelle K. Lee

Michelle K. Lee
*Deputy Director of the United States Patent and Trademark Office*